United States Patent [19]

Britton, Jr.

[11] 4,292,719

[45] Oct. 6, 1981

[54] ENGINE VALVE LIFTER SERVICE TOOL

[76] Inventor: Francis D. Britton, Jr., 200 Railroad Ave., Henry, Ill. 61537

[21] Appl. No.: 106,559

[22] Filed: Dec. 26, 1979

[51] Int. Cl.[3] ..... B26P 15/00

[52] U.S. Cl. ..... 29/156.4 R; 29/213 R; 29/280

[58] Field of Search ..... 29/213 R, 213 E, 270, 29/278, 280, 156.4 R; 294/19 R, 31.2, 100, 21; 119/153

[56] References Cited

U.S. PATENT DOCUMENTS

| | | | |
|---|---|---|---|
| 643,673 | 2/1900 | Morris | 119/153 |
| 1,724,435 | 8/1929 | Studwell | 294/19 R |
| 2,072,391 | 3/1937 | Varney | 29/278 |
| 2,207,888 | 7/1940 | Jones | 29/213 E |
| 3,145,463 | 8/1964 | Hockett | 29/229 |
| 3,174,216 | 3/1965 | Hamilton | 29/270 |

*Primary Examiner*—James L. Jones, Jr.
*Attorney, Agent, or Firm*—Claude F. White

[57] ABSTRACT

An engine service tool assembly (10) for removing defective hydraulic valve lifters (15) from an engine (16) and installing new lifters includes an actuating portion (11), a lifter engaging portion (12) and an intermediate elongated flexible housing portion (13). Present methods of removing defective hydraulic valve lifters consist of disassembly of several major engine components. The subject tool assembly (10) provides for easy removal and installation of hydraulic valve lifters with removal of minimal engine components.

9 Claims, 4 Drawing Figures

ENGINE VALVE LIFTER SERVICE TOOL

TECHNICAL FIELD

This invention relates generally to an internal combustion engine service tool assembly and more particularly to a tool assembly for servicing valve lifters of such engines.

BACKGROUND ART

Most internal combustion engines use hydraulic valve lifters to open and close the engine valves by means of push rods and rocker arms. The engine valves control the flow of fuel to the engine cylinders and the flow of exhaust gases out of the engine cylinders.

When one or more of the hydraulic valve lifters does not operate properly, the engine does not perform satisfactorily and it is necessary to replace the faulty valve lifter or lifters.

On many internal combustion engines, especially V-8 and V-6 model engines, it is an extremely difficult and time consuming job to remove a faulty hydraulic valve lifter and replace it with a new one. To accomplish this task, several major engine components must be removed to gain access to the valve lifter.

Some of the components which must be removed are sealed off from other parts of the engine by means of engine gaskets. These gaskets prevent engine coolant from becoming mixed with the lubricating oil and vice versa. Once these engine components are removed, new gaskets are required and it is often difficult to obtain a water or oil tight seal when the components are reassembled to the engine.

The present invention is directed to overcoming one or more of the problems as set forth above.

DISCLOSURE OF THE INVENTION

In one aspect of the present invention, a tool assembly provides for easy removal of an hydraulic valve lifter from an engine and easy installation of a new valve lifter. The tool assembly includes a portion for engaging the valve lifter and an actuating portion for urging the valve lifter engaging portion into gripping contact with the valve lifter.

Removal of one or more hydraulic valve lifters from an engine using prior technology and methods is a difficult and time consuming task. Several major engine components must be removed to gain access to the valve lifters and these components must be re-installed after the faulty valve lifters have been replaced.

The present invention eliminates the need to remove many of the engine components and thereby reduces the service time considerably. Much time and effort is saved and the integrity of the engine remains sound since no major seals are disturbed. Downtime of the automobile is reduced and the cost to the owner for servicing is also reduced.

BEST MODE FOR CARRYING OUT THE INVENTION

Figure 4:
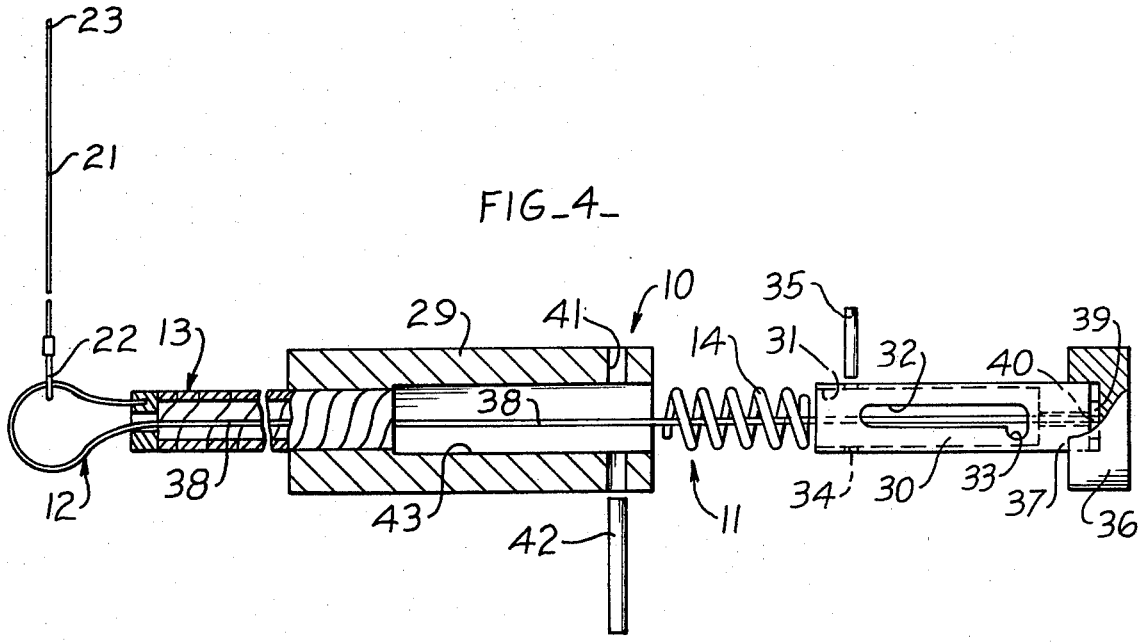
FIG. 4 is an enlarged sectional view, partially exploded, of the subject valve lifter tool assembly.

In the exemplary embodiment of the invention, as disclosed in the drawing, a tool assembly, generally designated 10, is shown to include an actuating portion 11, a valve lifter engaging portion 12, a flexible portion 13 between the actuating portion and the valve lifter engaging portion, and biasing means 14. The biasing means, as best shown in FIG. 4, comprises a spring 14 which urges the valve lifter engaging portion 12 into engagement with a valve lifter 15, as will hereinafter be explained in further detail.

Figure 1:
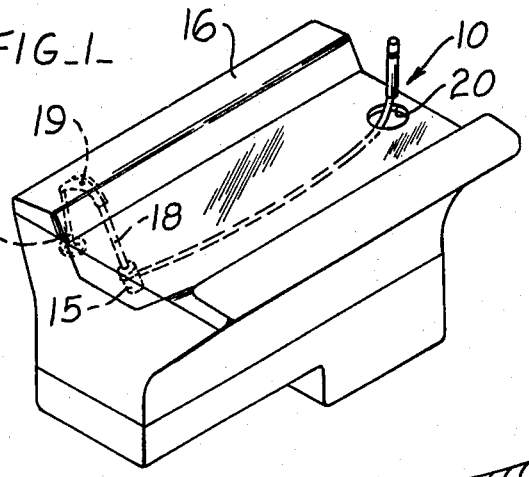
FIG. 1 is a schematic view of an internal combustion engine with the subject valve lifter tool assembly shown in place for servicing a lifter.
Figure 2:
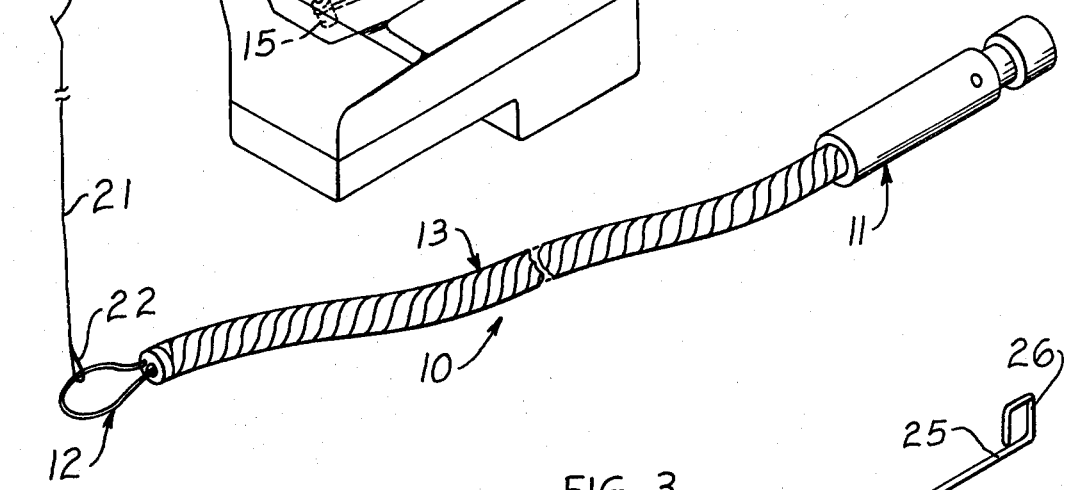
FIG. 2 is a perspective view of the valve lifter tool assembly.

Referring to FIG. 1, an internal combustion engine 16, shown here to be a V-8 or V-6 type engine, includes a plurality of hydraulic valve lifters 15, only one being shown for illustrative purposes. During operation of the engine, the valve lifter functions to activate an engine valve 17 by means of a push rod 18 and a rocker arm assembly 19. After some period of time of operation of the engine 16, one or more of the valve lifters 15 fail to function properly, which necessitates replacement. To accomplish this replacement, the valve lifter service tool assembly 10 is used.

To gain access to the faulty lifter 15, certain engine components (not shown) must be removed. These components include the air cleaner, the valve covers, the rocker arm assembly 19, and the push rod 18. The final component which needs to be removed, in order to provide access to an internal passageway within the engine is the distributor (not shown). The distributor normally fits partially within an opening 20 in the engine 16.

Figure 3:
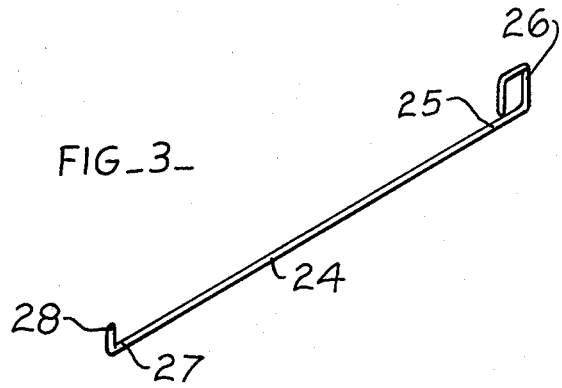
FIG. 3 is a perspective view of an auxillary hook member.

With the above noted parts removed from the engine, the tool assembly 10 is inserted into opening 20, with portion 12 entering first and actuating portion 11 remaining outside the opening. As the valve lifter engaging portion 12 approaches the lifter 15, it can be seen through an opening which normally accommodates the push rod 18. The engaging portion 12, which consists of a loop 12, is positioned over the lifter 15 in preparation of removing the lifter. To aid in positioning the engaging portion over the lifter, a flexible leader member 21 is provided. A first end 22 of the leader is slideably engaged with loop 12. A second end 23 of leader member 21 is drawn up through the push rod opening in order to help position the loop 12. To aid in drawing the end 23 up through the push rod opening, a hook member 24, as shown in FIG. 3, is provided. The hook member contains a first end 25 having a handle portion 26 and a second end 27 having a hook portion 28. The hook portion is inserted into the push rod opening and hooks end 23 of the leader member 21 and draws the end 23 out the opening.

The leader member 21 is used to help position the loop 12 over the valve lifter 15. When the loop is over the lifter, the actuating portion 11 of the tool assembly is activated and the loop 12 tightly grips the lifter 15. The tool assembly 10 is then removed from opening 20, bringing the valve lifter 15 with it. End 23, of leader member 21, however, remains extended out of the push rod hole in order to help guide a new valve lifter into place.

With particular reference to FIG. 4, a detailed description of the tool assembly will be given. The actuating portion 11 of the tool assembly includes a housing 29 for enclosing the spring 14 and a piston member 30. The piston member is adapted to move in and out of the housing 29. The piston member includes an internal cavity 31, a travel slot 32, and a detent 33. The piston also includes a cross bore 34 for receiving a stop pin 35 and a cap member 36. Cap member 36 is secured to the end 37 of piston member 30 and closes off the cavity 31.

The valve lifter engaging portion 12 includes an elongated member 38 which extends through flexible portion 13, through housing 29, and also through piston member 30. A stop member 39 is secured to end 40 of the elongated member 38 and abuts cap member 36. Housing 29 includes a cross bore 41 for receiving a guide pin 42 and a cavity 43.

To assemble actuating portion 11 of tool assembly 10, spring 10 is inserted into cavity 43 of housing 29 and piston member 30 is then inserted in cavity 43. As piston 30 enters cavity 43, a portion of spring 14 will enter cavity 31 of piston 30 until it contacts stop pin 35. Further movement of piston 30 into cavity 43 will compress spring 14. When travel slot 32 comes into registry with cross bore 41, guide pin 42 is inserted into cross bore 41 and through travel slot 32 of piston 30, to hold the piston within housing 29.

Piston 30 is moved further into cavity 43 until detent 33 is in alignment with guide pin 42. The piston is then rotated slightly to lock it to housing 29 by means of pin 42 in detent 33. In this position, spring 14 is compressed between housing 29 and stop pin 35. As previously described, when it is desired to tighten loop 12 around lifter 15, piston 30 is rotated slightly so pin 42 comes out of detent 33. Compressed spring 14 then forces piston 30 outwardly of cavity 43 as pin 42 travels along travel slot 32. Since stop member 39 is secured between piston 30 and cap 36, and since the elongated member 38 is secured to stop member 39, elongated member 38 is also forced outwardly of cavity 43, or to the right as viewed in FIG. 4. This movement of elongated member 38 tightens loop 12 around the valve lifter 15.

With the faulty valve lifter removed from the engine, a new valve lifter is inserted into loop 12 and the tool assembly is used to replace the new lifter into the engine. End 23, of leader member 21, is used to help reposition the new lifter, since end 23 remained extended out of the push rod hole. Once the new lifter is in place, the tool assembly 10 is withdrawn from opening 20 and the engine components are re-assembled to the engine to complete the service task.

INDUSTRIAL APPLICABILITY

The tool assembly 10 is especially adapted for servicing hydraulic valve lifters of internal combustion engines, specifically those having V-6 or V-8 type engines. The tool assembly is used to remove a worn or faulty hydraulic valve lifter from the engine and install a new valve lifter in its place. Access to the internal portion of the engine is gained through the opening left when the distributor is removed.

Present method require removal of several major engine components to gain access to the valve lifters. These include the intake manifold, including the carbureator, polution control devices, vacuum hoses, cruise control, water hoses, and other miscellaneous covers. All of the above components are in addition to what needs to be removed for servicing the valve lifters using the subject invention. The only components required to be removed in order to use the subject tool assembly are the valve covers, the air cleaner, the push rods and rocker arm assembly, and the distributor. To replace a valve lifter using the subject invention only 1/5 to 1/6 of the time is required as compared with prior methods.

Other aspects, objects, and advantages of this invention can be obtained from a study of the drawings, the disclosure, and the appended claims.

I claim:

1. A tool assembly (10) for removing an hydraulic valve lifter (15) from an engine (16) and installing an hydraulic valve lifter (15) in said engine (16) comprising:

an actuating portion (11) including a housing member (29) and a piston member (30) adapted to move into and out of said housing member (29);

a valve lifter engaging portion (12);

a flexible portion (13) intermediate said actuating portion (11) and said engaging portion (12);

biasing means (14) enclosed within said housing member (29) for urging said engaging portion (12) into engagement with said valve lifter (15); and said piston member (30) containing a travel slot (32) and a detent (33), said travel slot (32) limiting the travel of said piston (30) and said detent (33) locking said piston (30) to said housing member (29).

2. A tool assembly (10), as claimed in claim 1, wherein said valve lifter engaging portion (12) includes an elongated member (38) having a first end and a second end, said first end (40) having a stop (39) and said second end (12) forming a loop (12).

3. A tool assembly (10), as claimed in claim 1, including an elongated leader member (21) having a first end (22) and a second end (23), said first end (22) being engaged with said valve lifter engaging portion (12).

4. A tool assembly (10), as claimed in claim 1, including a guide pin (42) associated with said housing member (29) for guiding said movement of said piston member (30) within said housing member (29).

5. A tool assembly (10), as claimed in claim 1, wherein said piston member (30) includes means (35) for engaging said biasing means (14) and compressing said biasing means (14) as said piston (30) moves into said housing member (29).

6. A tool assembly (10), as claimed in claim 1, including a hook member (24) having a first end (25) having a handle portion (26) and a second end (27) having a hook portion (28).

7. A tool assembly (10), as claimed in claim 2, wherein said elongated member (38) includes an intermediate portion and said flexible portion (13) enclosed said intermediate portion.

8. A tool assembly (10), as claimed in claim 3, wherein said leader member (21) is slideably engaged with said valve lifter engaging portion (12).

9. A method of removing a defective hydraulic valve lifter (15) from an engine (16) and installing a new lifter (15) in said engine (16) comprising the steps of:

providing a valve lifter service tool (10) having a valve lifter engaging portion (12) and an actuating portion (11);

inserting said service tool (10) into the distributor opening (20) of said engine (16);

encircling said defective lifter (15) with said engaging portion (12);

actuating said actuating portion (11) to engage said defective lifter (15) with said engaging portion (12);

removing said service tool (10) and said defective lifter (15) from said engine (16) through said opening (20);

removing said defective lifter (15) from said engaging portion (12);

installing a new lifter (15) in said engaging portion (12);

inserting said service tool (10) and said new lifter (15) into said opening (20);

installing said new lifter (15) into position within said engine (16) using said tool (10);

releasing said new lifter (15) from said tool (10); and removing said tool (10) from said opening (20).

* * * * *